United States Patent [19]

Foil, Jr.

[11] 4,202,161

[45] May 13, 1980

[54] APPARATUS FOR PRODUCING NOVELTY YARN

[75] Inventor: Martin B. Foil, Jr., Mount Pleasant, N.C.

[73] Assignee: Tuscarora Yarns, Inc., Mount Pleasant, N.C.

[21] Appl. No.: 5,205

[22] Filed: Jan. 22, 1979

[51] Int. Cl.[2] ..... D02G 3/34

[52] U.S. Cl. ..... 57/12; 57/90; 57/207; 57/352; 242/157 R

[58] Field of Search ..... 57/3, 6, 12, 13, 18, 57/207, 90, 91, 352; 242/157 R

[56] References Cited

U.S. PATENT DOCUMENTS

| | | | |
|---|---|---|---|
| 2,309,095 | 1/1943 | Bry | 57/12 |
| 3,164,951 | 1/1965 | Donaldson et al. | 57/12 |
| 3,308,615 | 3/1967 | Susskind et al. | 57/207 |
| 3,334,483 | 8/1967 | Radcliffe | 57/207 |
| 3,339,355 | 9/1967 | O'Neill | 57/12 |
| 3,343,356 | 9/1967 | McKinnon | 57/12 |
| 3,380,241 | 4/1968 | Callaway | 57/207 X |
| 3,385,044 | 5/1968 | Anderson et al. | 57/12 |
| 3,389,545 | 6/1968 | Grunder et al. | 57/12 |
| 3,445,994 | 5/1969 | Nalpas | 57/18 X |
| 3,945,189 | 3/1976 | Allen | 57/91 X |

*Primary Examiner*—John Petrakes

*Attorney, Agent, or Firm*—Bell, Seltzer, Park & Gibson

[57] ABSTRACT

A conventional spinning or twisting machine is easily and inexpensively adapted for producing a unique novelty yarn by mounting an auxiliary strand guide device in accordance with this invention onto the strand guide support conventionally provided above the spindle. The auxiliary strand guide device is in the form of an elongate wire element having respective guides formed therein and located for directing respective effect and binder strands onto an advancing foundation strand for being wound thereabout to produce a novelty yarn.

19 Claims, 7 Drawing Figures

APPARATUS FOR PRODUCING NOVELTY YARN

FIELD OF THE INVENTION

The present invention relates to an apparatus for producing a novelty yarn on a conventional yarn processing machine such as a spinning or twisting machine.

BACKGROUND OF THE INVENTION

Commonly owned application Ser. No. 968,457 filed Dec. 11, 1978 and entitled NOVELTY YARN AND METHOD discloses a unique and appealing novelty yarn which is characterized by having effect loops of random size distributed at random locations along the yarn. The method disclosed in that application provides for producing such a yarn on a conventional yarn processing machine such as a spinning frame to thereby eliminate the need for using expensive and specialized machinery such as novelty twisters. The method involves advancing a foundation strand along a predetermined path of travel through a twisting zone and imparting twist to the foundation strand while directing an effect strand onto the foundation strand in the twisting zone and causing the effect strand to move in an oscillating manner along the foundation strand and to become wound about the foundation strand while at random intervals forming outwardly projecting loops of random size along the foundation strand. A binder strand is directed onto the foundation and effect strands while still in the twisting zone and the binder strand is caused to become wound about the yarn so as to bind the effect strand to the underlying foundation strand.

SUMMARY OF THE INVENTION

The present invention is directed to an apparatus designed for easily and inexpensively adapting a conventional spinning or twisting machine for producing novelty yarns. The present invention is particularly suited for carrying out the method of the aforementioned commonly owned copending application and for producing a novelty yarn of the type disclosed therein.

The present invention, more particularly, is directed to an auxiliary strand guide device for use on a conventional spinning or twisting machine for guiding respective effect and binder strands onto an advancing foundation strand for producing a novelty yarn therefrom. The auxiliary strand guide device of the present invention is adapted to be mounted to the strand guide support which is conventionally provided above the spindle of a spinning or twisting machine to enable the machine to be easily and inexpensively converted for producing novelty yarns. The auxiliary strand guide device is conveniently located closely adjacent to the yarn guide which is conventionally provided for the main or foundation strand, and the auxiliary strand guide device may thus be pivotally moved as a unit with the foundation strand guide out of the path of travel of the foundation strand to facilitate doffing.

Although the auxiliary strand guide device of the present invention is specifically designed to permit novelty yarns to be produced on a conventional spinning or twisting frame, the installation of the auxiliary strand guide device on a spinning or twisting frame does not interfere with the normal functions of the spinning or twisting frame, and permits the frame to also be used in the conventional manner, when desired, for producing conventional yarns.

The auxiliary strand guide device of the present invention comprises a guide for the effect strand positioned upstream from the guide for the foundation strand and laterally offset from the path of travel of the foundation strand and adapted for guiding the effect strand onto the advancing foundation strand while allowing the effect strand to move in an oscillating manner along the advancing foundation strand and to become wound thereabout. The auxiliary strand guide device may also include a guide for the binder strand positioned upstream from the foundation strand guide and downstream from the effect strand guide and also being laterally offset from the path of travel of the advancing foundation strand and adapted for guiding the binder strand onto the advancing foundation strand following the application of the effect strand for binding the effect strand to the underlying foundation strand.

In accordance with a further feature of the invention the auxiliary strand guide device may include an additional guide for the effect strand located adjacent to the effect strand guide and closer to the path of travel of the advancing foundation strand. This additional effect strand guide is adapted for engaging the effect strand in its travel from the effect strand guide to the advancing foundation strand and for limiting the oscillating movement of the effect strand.

The strand guide device of the present invention is preferably in the form of an elongate wire element with the effect strand guide and the binder strand guide comprising loops formed in the wire element at spaced locations therealong and defining respective eyes through which the effect and binder strands are adapted to pass.

BRIEF DESCRIPTION OF THE DRAWINGS

Some of the features of the invention having been stated, others will become apparent as the description proceeds, when taken in connection with the accompanying drawings, in which--

DETAILED DESCRIPTION OF ILLUSTRATIVE EMBODIMENTS

The detailed description which follows and the accompanying drawings illustrate how the auxiliary strand guide device of the present invention may be used in connection with a conventional spinning frame for producing a novelty yarn on the spinning frame without requiring any substantial modification thereto. From this description it should be apparent to persons familiar with textile machinery how the auxiliary strand guide device could be used in connection with the other conventional textile machinery adapted for processing yarns, such as a twisting machine for example.

Figure 1:
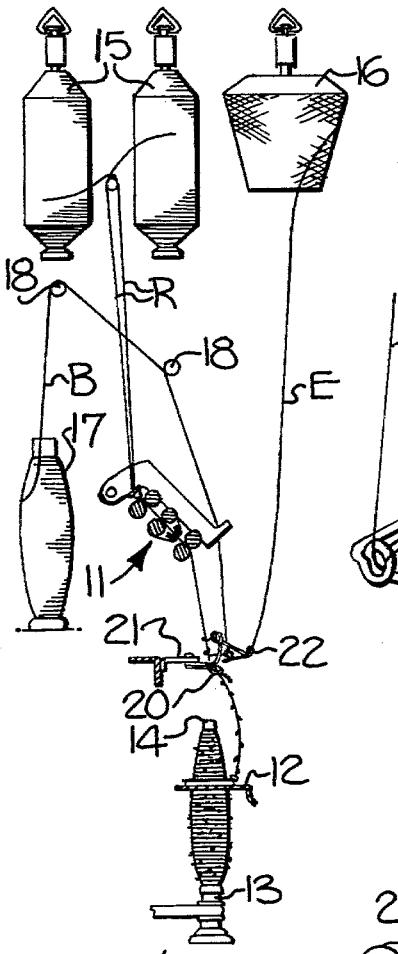
FIG. 1 is a schematic side view of a conventional spinning frame which has been equipped with an auxiliary strand guide device in accordance with the present invention.

Referring now more particularly to the drawings, FIG. 1 schematically illustrates a conventional ring spinning frame including a drafting system 11, a reciprocating ring 12, and a rotating spindle 13. As is conventional, one or more rovings are directed from their supply packages 15 and to the drafting system 11 where they are drafted by a series of cooperating pairs of drafting rolls to form a single strand of staple fibers. Upon leaving the drafting system, the strand advances downwardly to the ring 12 and thence to the spindle 13 where the strand is wound on a bobbin 14 mounted on the rotating spindle.

In its travel from the delivery rolls of the drafting system 11 to the spindle 13, the strand passes through a strand guide 20, and the advancing strand forms a balloon between the guide 20 and the ring 12 as it is wound on the bobbin. The strand guide 20 is supported by a strand guide support 21 located above the spindle. The strand guide support 21 is pivotally mounted to the spinning machine and adapted to normally position the strand guide 20 in a horizontally extending orientation in the path of travel of the advancing strand. However, the support 21 is adapted to be pivoted upwardly so as to move the strand guide 20 out of the path of travel of the strand and out of the way to facilitate doffing of the bobbin 14 from the spindle 13.

As is well known, the winding of the strand on the bobbin causes twist to be imparted to the strand as it advances from the delivery rolls of the drafting system to the bobbin. The twist imparted to the advancing yarn backs up along the advancing strand to the delivery rolls. Thus, the area between the delivery rolls and the spindle may be viewed as a twisting zone where twist is imparted to the advancing strand.

The strand which is advancing through the twisting zone serves as the foundation strand F in the novelty yarn. One or more effect strands E are directed onto the foundation strand F as it advances in the twisting zone between the delivery rolls and the spindle, and as a result of the twist being imparted to the foundation strand, the effect strand E will become wound about the foundation strand.

As disclosed more fully in the aforementioned commonly owned copending application, by supplying the effect strand E to the foundation strand F under properly controlled conditions of very low tension, the effect strand E can be caused to move in an unpredictable oscillating manner along the foundation strand F while becoming wound about the foundation strand and while at random intervals forming multiple layer deposits of effect strand having outwardly projecting effect strand loops of random size. As shown in FIG. 1, the supply package 16 for the effect strand E is mounted in an elevated location and the effect strand is allowed to fall, essentially unrestricted, downwardly from the supply package 16 to the twisting zone where it is combined with the advancing foundation strand F.

Figure 2:
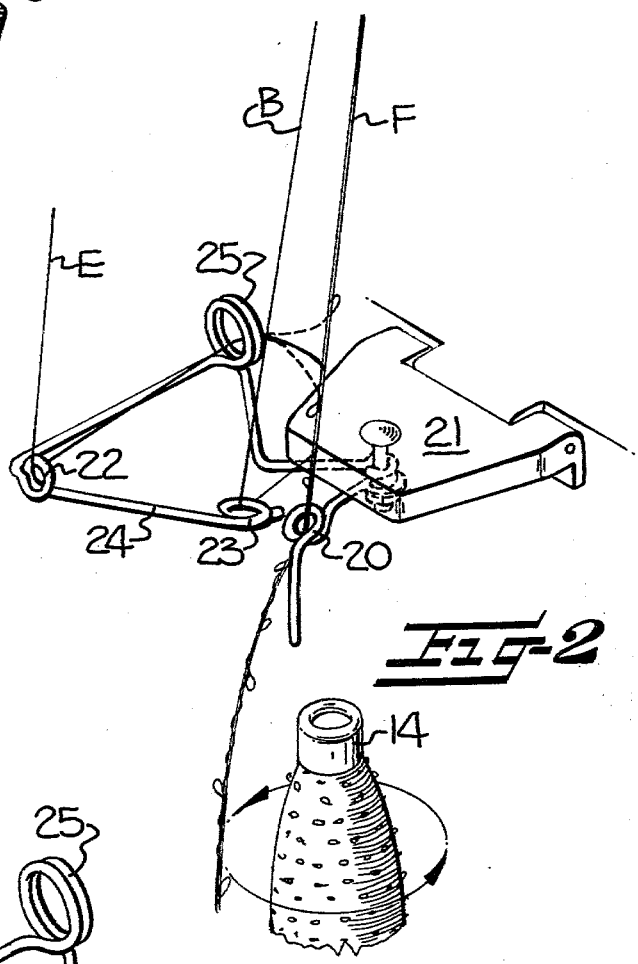
FIG. 2 is an enlarged perspective view of a portion of the spinning frame showing the auxiliary strand guide device of the present invention mounted to the strand guide support provided above the spindle.
Figure 3:
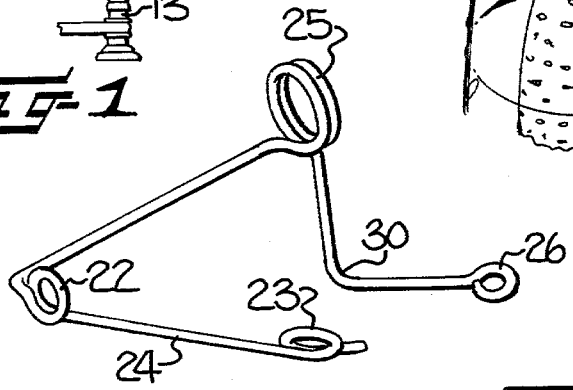
FIG. 3 is a perspective view of the strand guide device.
Figure 4:
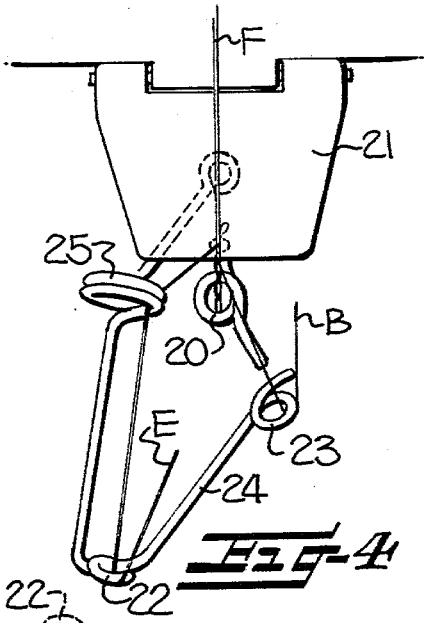
FIG. 4 is a plan view of the strand guide device as illustrated in FIG. 3.

In accordance with the present invention and as illustrated in FIG. 2, the effect strand E is combined with the advancing foundation strand F before the foundation strand passes through guide 20. The effect strand E is directed from its supply package 16 and to and through a guide 22 located adjacent the path of travel of the advancing foundation strand, and the effect strand is thence directed onto the foundation strand F. The guide 22 is located upstream with respect to the advancing foundation strand from the foundation strand guide 20 and is laterally offset to one side of the path of travel of the foundation strand.

Desirably, a binder strand is applied to the advancing strands immediately following the application of the effect strand for binding the effect strand to the underlying foundation strand. As illustrated in FIG. 1, the binder strand B is directed from its supply package 17, over and around guide rods 18 and to a guide 23 located adjacent the path of travel of the foundation strand. Upon passing through the guide 23, the binder strand is directed onto the foundation strand where it becomes wound about the foundation strand and the effect strand and binds the effect strand to the underlying foundation strand. As illustrated, the binder strand guide 23 is located upstream from the foundation strand guide 20 but downstream from the effect strand guide 22. The binder strand guide 23 is also laterally offset from the path of travel of the advancing foundation strand, although preferably and as illustrated, the lateral distance between the binder strand guide 23 and the path of travel of the advancing foundation strand is less than the lateral distance between the effect strand guide 22 and the path of travel of the foundation strand.

In accordance with the embodiment of the invention illustrated herein, the effect strand guide 22 and the binder strand guide 23 are provided on a common auxiliary strand guide device 24 which is carried by the strand guide support 21. More particularly, the auxiliary strand guide device 24 is in the form of an elongate wire element which is bent into a non-linear configuration, with the effect strand guide 22 and the binder strand guide 23 comprising loops formed in the wire element at spaced locations therealong. The loops formed in the wire element define respective guide eyes through which the effect and binder strands are adapted to pass.

In accordance with one aspect of the invention, the effect strand E may, if desired, be directed from the guide 22 and to and through an additional effect strand guide 25 located adjacent to the effect strand guide 22 and closer to the path of travel of the foundation strand. This additional effect strand guide 25 serves to limit the amplitude of oscillating movement of the effect strand E by engaging the effect strand during its oscillating movement at a location between the guide 22 and the point where the effect strand joins the advancing foundation strand. Limiting the oscillating movement of the effect strand in this manner provides a means for varying the average size and spacing of the multiple layer deposits of effect strand and the outwardly projecting loops formed thereby.

As illustrated, the additional effect strand guide 25 is in the form of a circular eye. The size of the eye may be varied as desired to permit adjustably varying the average size and spacing of the multiple layer deposits and the random size loops formed in the novelty yarn. The eye is located closer to the path of travel of the foundation strand than guide 22 and a short distance laterally to one side of a direct line extending from the guide 22 to the foundation strand. Thus, the effect strand E engages one side of the eye as it advances from the guide 22 to the foundation strand, and is deflected slightly out of its normal direct path of travel from guide 22 to the foundation strand. The eye is arranged in a vertical plane to allow vertical oscillating movement of the effect strand within the eye.

In the embodiment illustrated in FIGS. 2 to 6, one end of the auxiliary strand guide device 24 is bent in a circular configuration to form a closed eye 26 which serves to facilitate mounting the auxiliary strand guide device 24 to the strand guide support 21. A bolt 27 extends through the strand guide support 21 for securing both the foundation strand guide 20 and the auxiliary strand guide device 24 to the support 21. A right angle bend 30 formed in the auxiliary strand guide device 24 between the mounting eye 26 and the additional effect strand guide 25 serves for positioning the guide 25 in a vertically offset position upstream of the foundation strand guide 20.

The binder strand guide 23 is formed in the strand guide device 24 adjacent the far end thereof from the mounting eye 26. As illustrated, the binder strand guide 23 is in the form of a pigtail loop formed in the wire element with the turns or convolutions of the loop being helically arranged in spaced apart relation and adapted for receiving and retaining the binder strand therein while facilitating the threading of the binder strand into the loop.

The effect strand guide 22 is formed in a medial portion of the auxiliary strand guide device 24 between the binder strand guide 23 and the additional effect strand guide 25. The effect strand guide 22 is defined by a loop formed in the wire element and located at the apex of a relatively sharp annular bend in the wire element. It will thus be seen that the auxiliary strand guide device 24 has a geniculate configuration between the additional effect strand guide 25 and the binder strand guide 23 with the effect strand guide 22 being positioned in laterally spaced relation a predetermined distance away from the path of travel of the advancing foundation strand and with the binder strand guide 23 and the additional effect strand guide 25 being positioned closer to the path of travel of the advancing foundation strand.

Figure 5:
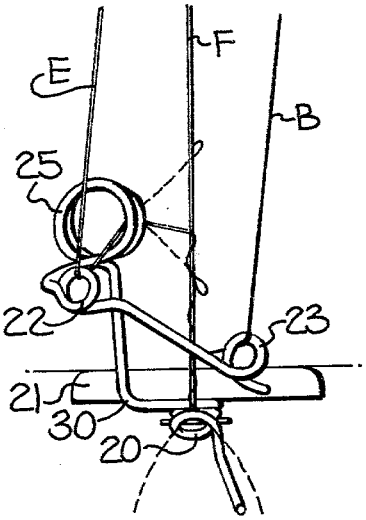
FIG. 5 is a front elevational view of the strand guide device as illustrated in FIG. 3.
Figure 6:
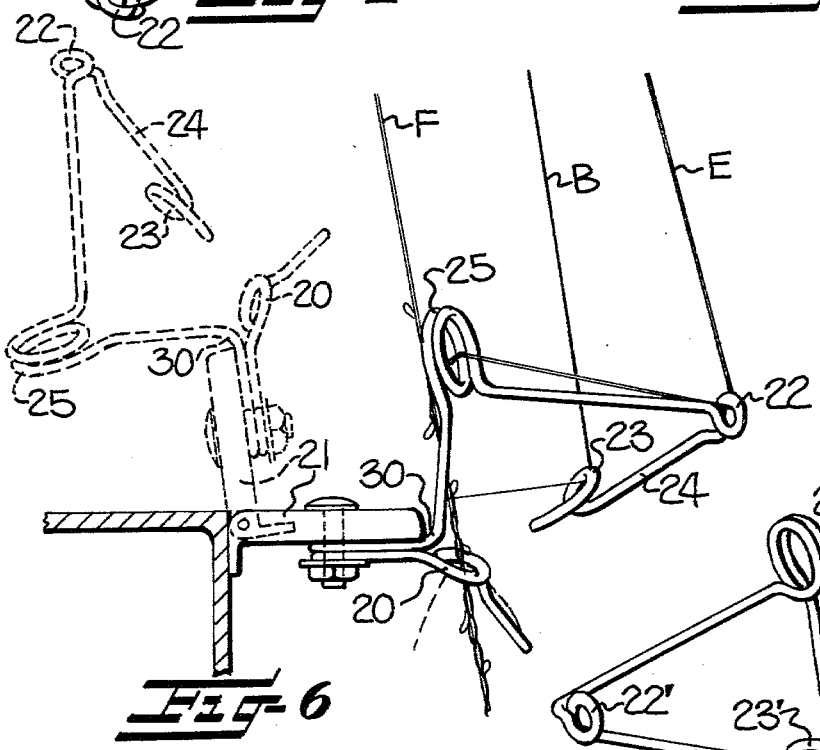
FIG. 6 is a side elevational view of the strand guide device as illustrated in FIG. 3.

From FIGS. 5 and 6 it will be seen that the effect strand guide 22, the binder strand guide 23 and the additional effect strand guide 25 are all vertically offset upstream from, i.e. at a higher elevation than, the foundation strand guide 20. The additional effect strand guide 25 is positioned uppermost, with the effect strand guide 22 being vertically offset downwardly therefrom. Thus, as is best seen in FIG. 6, the effect strand E, upon passing through the effect strand guide 22 follows an upwardly inclined path of travel to and through the additional guide 25 and thence to the foundation strand.

The binder strand guide 23 is vertically offset at a lower elevation than the effect strand guide 22 but at a higher elevation than the foundation strand guide 20. The binder strand B, upon passing through the binder strand guide 23, thus travels in a nearly horizontal direction and is applied to the advancing foundation strand below the point of application of the effect strand but prior to the combined foundation strand and effect strand passing through the foundation strand guide 20.

As noted previously, the auxiliary strand guide device 24 is mounted on the pivotable strand guide support 21 along with the foundation strand guide 20. This is a significant feature of the invention since it permits the binder strand guide 23 and effect strand guides 22 and 25 to be pivotally moved as a unit with the foundation strand guide 20 out of the normal path of travel of the advancing foundation strand to facilitate periodic doffing of full bobbins from the spindle. This is indicated by the broken lines in FIG. 6. During the periodic doffing operations, the binder and effect strands remain threaded through their respective guides and onto the foundation strand so that the doffing operation can proceed unimpeded in essentially the same way as when conventional yarns are produced on the spinning frame. It will also be seen that this mounting arrangement for the auxiliary strand guide device 24 does not interfere with the normal operation of the spinning or twisting frame. Thus, if one should desire from time to time to produce conventional yarns on the spinning or twisting frame, this can be accomplished without the need for modifying the frame or removing the auxiliary strand guide device 24 therefrom. The auxiliary strand guide device 24 may simply be left in place with the binder strand guide 23 and effect strand guides 22 and 25 unused.

Figure 7:
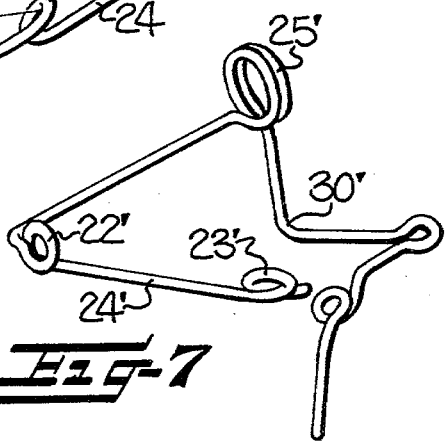
FIG. 7 is a perspective view of an alternate form of the strand guide device in accordance with the present invention.

The alternate form of the invention illustrated in FIG. 7 is quite similar to that previously described with reference to FIGS. 1 to 6. To avoid repetitive description, elements in the FIG. 7 embodiment which correspond to elements already described in the previous embodiment will bear the same reference characters with prime notation added. Referring now more particularly to FIG. 7, it will be seen that this embodiment differs over that previously described in that the foundation strand guide 20', instead of being separate from the auxiliary strand guide device 24', is formed as an integral part thereof. The wire element which defines the auxiliary strand guide device 24' forms a U-shaped bend which defines an eye 26' for receiving the bolt 27' for thereby securing the auxiliary strand guide device 24' to the strand guide support 21'. The foundation strand guide 20' is formed in the wire element on the opposite side of the eye 26' from the binder strand guide 23' and effect strand guides 22' and 25'.

In the drawings and specifications, there have been set forth preferred embodiments of the invention, and although specific terms are employed, they are used in a generic and descriptive sense only and not for purposes of limitation.

That which is claimed is:

1. In a spinning or twisting machine of the type having a rotatable spindle and delivery rolls for delivering a strand to the spindle for being wound to form a package, and said machine having a strand guide carried by a strand guide support and positioned for guiding the strand in its path of travel from the delivery rolls to the spindle, and wherein the strand is adapted to serve as a foundation strand in the production of a novelty yarn therefrom, the combination therewith of auxiliary strand guide means also carried by said support and adapted for guiding respective effect and binder strands onto the advancing foundation strand for becoming wound thereabout to produce a novelty yarn, said auxiliary strand guide means comprising a guide for the effect strand positioned upstream from said guide for the foundation strand and laterally offset from the path of travel of the foundation strand and adapted for guiding the effect strand onto the advancing foundation strand while allowing the effect strand to move in an oscillating manner along the advancing foundation strand and to become wound thereabout, and a guide for the binder strand positioned upstream from said foundation strand guide and downstream from said effect strand guide and also being laterally offset from the path of travel of the advancing foundation strand and adapted for guiding the binder strand onto the advancing foundation and effect strands for binding the effect strand to the underlying foundation strand.

2. The combination according to claim 1 wherein the lateral distance between said binder strand guide and the path of travel of the advancing foundation strand is less than the lateral distance between said effect strand guide and the path of travel of the advancing foundation strand.

3. The combination according to claim 1 wherein said effect strand guide and said binder strand guide comprise respective eyes through which the effect and binder strands are adapted to pass.

4. The combination according to claim 1 wherein said auxiliary strand guide means comprises an elongate wire element carried by said strand guide support, and wherein said effect strand guide and said binder strand guide comprise loops formed in said wire element at spaced locations therealong and defining respective eye through which the effect and binder strands are adapted to pass.

5. The combination according to claim 4 wherein said guide for the foundation strand is integrally formed with said elongate wire element and comprises an additional loop formed in the wire element and defining an eye through which the foundation strand is adapted to pass.

6. The combination according to claim 4 wherein said guide for the foundation strand is separate from said elongate wire element and comprises a separate pigtail guide also carried by said strand guide support.

7. The combination according to claim 1 including an additional guide for engaging the effect strand in its travel from said effect strand guide to the advancing foundation strand for limiting the oscillating movement of the effect strand.

8. The combination according to claim 7 wherein said additional guide for the effect strand comprises an eye through which the effect strand is adapted to pass in its travel from said effect strand guide to the advancing foundation strand.

9. In a spinning or twisting machine of the type having a rotatable spindle and delivery rolls for delivering a strand to the spindle for being wound to form a package, and said machine having a strand guide carried by a strand guide support and positioned for guiding the strand in its path of travel from the delivery rolls to the spindle, and wherein the strand is adapted to serve as a foundation strand in the production of a novelty yarn therefrom, the combination therewith of auxiliary strand guide means also carried by said support and adapted for guiding an effect strand onto the advancing foundation strand for becoming wound thereabout to produce a novelty yarn, said auxiliary strand guide means comprising a guide for the effect strand positioned upstream from said guide for the foundation strand and laterally offset from the path of travel of the foundation strand and adapted for guiding the effect strand onto the advancing foundation strand while allowing the effect strand to move in an oscillating manner along the advancing foundation strand and to become wound thereabout, and an additional guide for engaging the effect strand in its travel from said effect strand guide to the advancing foundation strand for limiting the oscillating movement of the effect strand.

10. The combination according to claim 9 wherein said effect strand guide comprises an eye through which the effect strand is adapted to pass.

11. The combination according to claim 10 wherein said additional guide for the effect strand also comprises an eye through which the effect strand is adapted to pass in its travel from the said effect strand guide to the advancing foundation strand.

12. The combination according to claim 11 wherein said eye of said additional effect strand guide is of larger size than the eye of said effect strand guide.

13. The combination according to claim 9 wherein said additional guide for the effect strand is positioned upstream from said effect strand guide.

14. The combination according to claim 9 wherein said auxiliary strand guide means comprises an elongate wire element carried by said strand guide support and wherein said effect strand guide and said additional effect strand guide comprises loops formed in said wire element at spaced locations therealong and defining respective eyes for the effect strand to pass successively therethrough.

15. The combination according to claim 14 wherein said guide for the foundation strand is integrally formed with said elongated wire element and comprises an additional loop formed in said wire element and defining an eye through which the foundation strand is adapted to pass.

16. The combination according to claim 14 wherein said guide for the foundation strand is separate from said elongate wire element and comprises a separate pigtail guide also carried by said strand guide support.

17. In a spinning or twisting machine of the type having a rotatable spindle and delivery rolls for delivering a strand to the spindle for being wound to form a package, and said machine having a strand guide eye carried by a strand guide support positioned for guiding the strand in its path of travel from the delivery rolls to the spindle, and wherein the strand is adapted to serve as a foundation strand in the production of a novelty yarn therefrom, the combination therewith of auxiliary strand guide means also carried by said support and adapted for guiding respective effect and binder strands onto the advancing foundation strand for producing a novelty yarn therefrom, said auxiliary strand guide means comprising a guide eye for receiving the effect strand therethrough, said effect strand eye being positioned upstream from said guide eye for the foundation strand and laterally offset from the path of travel of the foundation strand and adapted for guiding the effect strand onto the advancing foundation strand while allowing the effect strand to move in an oscillating manner along the advancing foundation strand and to become wound thereabout, an additional guide eye for receiving the effect strand therethrough in its travel from said effect strand eye to the advancing foundation strand and for limiting the oscillating movement of the effect strand, and a guide eye for receiving the binder strand therethrough, said binder strand eye being positioned upstream from said foundation strand eye and downstream from said effect strand eye and also being laterally offset from the path of travel of the advancing foundation strand and adapted for guiding the binder strand onto the advancing foundation and effect strands for binding the effect strand to the underlying foundation strand.

18. The combination according to claim 17 wherein said auxiliary strand guide means comprises an elongate bent wire element carried by said strand guide support, and wherein said effect strand eye, said additional effect strand eye, and said binder strand eye comprise respective loops formed in said wire element at spaced locations therealong.

19. In a spinning or twisting machine of the type having a rotatable spindle and delivery rolls for delivering a strand to the spindle for being wound to form a package, and said machine having a strand guide carried by a pivotally mounted strand guide support and normally being positioned for guiding the strand in its path of travel from the delivery rolls to the spindle but adapted for being pivoted out of the path of travel to facilitate doffing, and wherein the strand is adapted to serve as a foundation strand in the production of a novelty yarn therefrom, the combination therewith of auxiliary strand guide means also carried by said pivotally mounted support and normally being positioned for guiding respective effect and binder strands onto the advancing foundation strand for becoming wound thereabout to produce a novelty yarn, said auxiliary strand guide means comprising an elongate bent wire element having means adjacent one end thereof for facilitating securement to said support and having a plurality of strand guide eyes formed therein at spaced locations therealong, one of said strand guide eyes comprising a guide for the effect strand and being positioned upstream from said guide for the foundation strand and laterally offset from the path of travel of the foundation strand and adapted for guiding the effect strand onto the advancing foundation strand while allowing the effect strand to move in an oscillating manner along the advancing foundation strand and to become wound thereabout, and another of said strand guide eyes comprising a guide for the binder strand and being positioned upstream from said foundation strand guide and downstream from said effect strand guide and also being laterally offset from the path of travel of the advancing foundation strand and adapted for guiding the binder strand onto the advancing foundation and effect strands for binding the effect strand to the underlying foundation strand.

* * * * *